US009784446B2

(12) United States Patent
Tsai

(10) Patent No.: US 9,784,446 B2
(45) Date of Patent: Oct. 10, 2017

(54) GAS COMBUSTOR HAVING DETACHABLE COMBUSTION DEVICE

(71) Applicant: Chin-Lin Tsai, New Taipei (TW)

(72) Inventor: Chin-Lin Tsai, New Taipei (TW)

( * ) Notice: Subject to any disclaimer, the term of this patent is extended or adjusted under 35 U.S.C. 154(b) by 417 days.

(21) Appl. No.: 14/682,634

(22) Filed: Apr. 9, 2015

(65) Prior Publication Data

US 2016/0047543 A1 Feb. 18, 2016

(30) Foreign Application Priority Data

Aug. 13, 2014 (TW) ..... 103214422 U

(51) Int. Cl.

| | |
|---|---|
| ***F23D 14/28*** | (2006.01) |
| ***F23D 14/38*** | (2006.01) |
| ***F23D 14/52*** | (2006.01) |
| ***F23D 14/58*** | (2006.01) |
| ***F23Q 2/00*** | (2006.01) |
| ***F23Q 3/00*** | (2006.01) |
| ***F23D 14/64*** | (2006.01) |
| ***F23D 14/72*** | (2006.01) |
| ***F23Q 2/173*** | (2006.01) |

(52) U.S. Cl.

CPC ..... *F23D 14/28* (2013.01); *F23D 14/38* (2013.01); *F23D 14/52* (2013.01); *F23D 14/58* (2013.01); *F23D 14/64* (2013.01); *F23D 14/72* (2013.01); *F23Q 2/173* (2013.01); *F23Q 3/002* (2013.01); *F23D 2213/00* (2013.01); *F23D 2900/14701* (2013.01)

(58) Field of Classification Search

CPC ..... F23D 14/28; F23D 14/38; F23D 14/52; F23D 14/58; F23D 14/64; F23D 14/72; F23Q 2/173; F23Q 3/002

USPC ..... 431/153

See application file for complete search history.

(56) References Cited

U.S. PATENT DOCUMENTS 8,449,290 B2 5/2013 Tsai

FOREIGN PATENT DOCUMENTS

TW I414728 B 11/2013

*Primary Examiner* — Kenneth Rinehart
*Assistant Examiner* — Alex Girard
(74) *Attorney, Agent, or Firm* — Guice Patents PLLC

(57) ABSTRACT

The present invention provides a gas combustor having detachable combustion device, which includes: a housing having the interior installed with a base, and a combustion device. When the combustion device is inserted in an insertion slot of the housing, the upstream end of a mix pipe of the combustion device is airtightly inserted in a sleeve opening of the base, and a pair of locking sheets of the combustion device are moved along a pair of stopping protrusions of the housing and cross the pair of stopping protrusions, so a first spring between a lock button and a positioning seat of the combustion device is allowed to respectively be compressed for storing energy or stretched for releasing energy, and the pair of locking sheets are enabled to be abutted against inner edges of the pair of stopping protrusions, so an interference is generated for forming a locking and combining status.

12 Claims, 6 Drawing Sheets

GAS COMBUSTOR HAVING DETACHABLE COMBUSTION DEVICE

BACKGROUND OF THE INVENTION

1. Field of the Invention

The present invention relates to gas combustor, especially to a gas combustor having detachable combustion device.

2. Description of Related Art

Fire is a must have element in our lives, with fire, we can cook food, can be provided with lighting, and the fire can also be used for combustion operations such as forging, soldering and welding. Take a canned gas for example, liquid gas is contained therein, the canned gas can be used for refilling a lighter or combined in a portable gas stove for lighting objects or cooking food, thereby providing convenience in use. Thus, the canned gas plays an important role in our lives which cannot be easily replaced.

With the convenience provided by the canned gas, there are two types of gas combustors in the marketplace, the first type is provided with a fuel (e.g. gas) storing function, in others words the gas combustor is installed with a filling nozzle, after the filling nozzle is connected to a gas discharge valve of a canned gas, liquid gas can be injected into a fuel storage tank of the gas combustor for the purpose of storage, so a combustion device of the gas combustor is able to be supplied with fuel for combustion operation.

The second type is not provided with the fuel storing function, the gas combustor is installed with an engage device for being connected to a canned gas available in the marketplace; after the fuel in the canned gas is vaporized, the fuel gas is able to be supplied to a combustion device of the gas combustor for combustion operation.

As such, the combustion device of the conventional gas combustor is fastened at the distal end of a fuel channel, and the mixed fuel gas ejected by the combustion device is ignited through an igniter, e.g. a piezoelectric device, or an external fire source, e.g. a lighter, for performing the combustion operation.

However, when the combustion operation is processed, the single type of flame ejected by the combustion device is unable to satisfy different combustion requirements, so several gas combustor having different types of flames have to be prepared; as such, how to modularize the combustion devices having various types of flames for satisfying different combustion requirements and enabling the gas combustor to be easily and rapidly combined with or detached from the selected combustion device shall be seriously concerned by skilled people in the art.

SUMMARY OF THE INVENTION

One primary objective of the present invention is to provide a gas combustor, in which a base inside a housing is enabled to be selectively combined with or detached from a desired combustion device, thereby allowing the gas combustor to be provided with a function of replacing combustion device for satisfying different combustion requirements.

Another objective of the present invention is to provide a gas combustor, in which a combustion device is able to be rapidly combined with or detached from the gas combustor, thereby being provided with advantages of effectively reducing the package volume and easy to be carried around.

For achieving said objectives, one technical solution provided by the present invention is to provide a gas combustor having detachable combustion device, which includes: a housing, the interior thereof is installed with a base formed with a fuel channel, the housing is installed with a connection pipe at the downstream end of the fuel channel, an opening of an insertion slot axially formed in the connection pipe is installed with a pair of stopping protrusions, and the downstream end of the fuel channel is installed with a sleeve pipe having a sleeve opening; and a combustion device including a mix pipe sleeved in a positioning seat, the downstream end of the mix pipe is connected to an external pipe and the upstream end thereof is formed with at least a ventilation hole, one end of a lock button is pivoted at the bottom end of the positioning seat, and the other end of the lock button is radially provided with a press button, a first spring is disposed between the press button and the bottom end of the positioning seat, and two sides of the lock button are oppositely formed with a pair of locking sheets; when the combustion device is inserted in the insertion slot, the upstream end of the mix pipe is airtightly inserted in the sleeve opening, and the pair of locking sheets are moved along the pair of stopping protrusions and cross the pair of stopping protrusions, so the lock button allows the first spring to respectively be compressed for storing energy or stretched for releasing energy, and the pair of locking sheets are enabled to be abutted against inner edges of the pair of stopping protrusions, so an interference is generated for forming a locking and combining status; when the press button is pressed, the lock button allows the first spring to be compressed for storing energy, and the pair of locking sheets are upwardly moved for being on top of the pair of stopping protrusions, so the combustion device is able to be outwardly removed, thereby forming an unlocking and detaching status.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Referring from FIG. 1 to FIG. 6, the present invention provides a gas combustor, which includes a housing 1, a base 2 and a combustion device 3.

Figure 1:
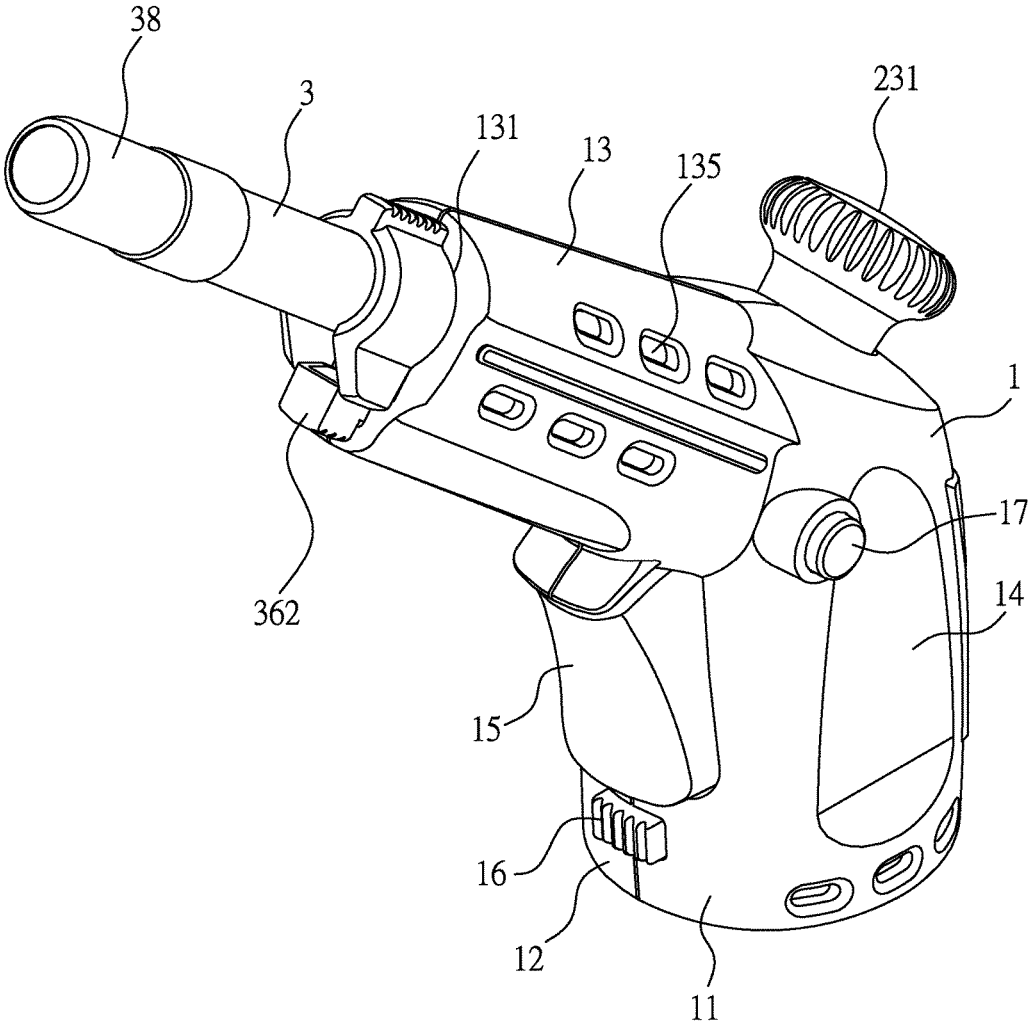
FIG. 1 is a perspective view illustrating the gas combustor according to the present invention.

The housing 1 is composed of a left shell 11 and a right shell 12 being engaged with each other and used for enclosing the base 2, and the left and the right shells 11, 12 are formed with a plurality of tenons, ribs, slots and/or holes for allowing the base 2 to be positioned and accommodated. The assembly of the gas combustor is as shown in FIG. 1, wherein the housing 1 is provided with a connection pipe 13 at the downstream end of a fuel channel formed in the base 2, and an end part of the connection pipe 13 is formed with an insertion slot 131. The insertion slot 131 is detachably connected to the combustion device 3 having different gas guiding set 37.

The housing 1 is formed with a handgrip part 14 at the front end of the fuel channel of the base 2. The front end defined at the connecting position of the handgrip part 14 and the connection pipe 13 is pivoted with a trigger button 15 capable of being pressed, and the handgrip part 14 is protrudingly installed with a safety button 16 capable of being transversally pushed and moved at the bottom end of the trigger button 15. When the safety button 16 is at a first position defined as not being pushed and moved, the safety button 16 is able to interfere with the trigger button 15, so the trigger button 15 is unable to be pressed, thereby forming a locking status for preventing children from accidentally touching or pressing so as to increase the safety in use. When the safety button 16 is pushed and moved to a second position, the interference applied to the trigger button 15 is released, thereby forming an unlocking status, and the trigger button 15 is able to press a first control valve 22 of the base 2 for allowing a valve rod 221 of the first control valve 22 to be retracted so as to supply fuel gas.

In addition, the handgrip part 14 is protrudingly provided with a continuous button 17 at one lateral side of the trigger button 15 of the housing 1, when the trigger button 15 is pressed for being in a fuel gas supplying status, a user is enabled to push the continuous button 17 from the first position to the second position (i.e. push towards inward), so a hook part 171 of the continuous button 17 is buckled with a buckle part 151 of the trigger button 15, thereby enabling the trigger button 15 to be pressed for forming a continuous fuel gas supplying status. When the trigger button 15 is pressed once again, the buckle part 151 is slightly moved towards inward thereby allowing the hook part 171 to be released, and an elastic member 172 sleeved between the continuous button 17 and the housing 1 is served to provide an elastic force (e.g. an spring energy releasing effect) for allowing the continuous button 17 to be recovered from the second position to the first position (i.e. pushed towards outward), so the interference applied by the continuous button 17 to the trigger button 15 is released, and the trigger button 15 is able to stop pressing the first control valve 22 through an elastic unit 152, e.g. a spring, and a piezoelectric device 18 fastened in the housing 1 being stretched, thereby forming a fuel gas terminating status. Wherein, the elastic unit 152 is disposed between the trigger button 15 and the housing 1.

Moreover, the top end of the handgrip part 14 is additionally installed with a rotary control button 231 capable of controlling the fuel gas supply and the amount of discharged gas in the base 2, wherein the rotary control button 231 is connected to a second control valve 23, e.g. a pressure stabilizing device, of the base 2 for controlling the fuel gas flowing towards the downstream end of the fuel channel in the base 2 and the amount of discharged gas.

In fact, the trigger button 15, the safety button 16, the continuous button 17 and the rotary control button 231 are well known by the skilled people in the art and some of the above-mentioned has already been disclosed in the Taiwan Patent NO. I414728 (corresponding to the U.S. Pat. No. 8,449,290), therefore no further illustration is provided.

Figure 2:
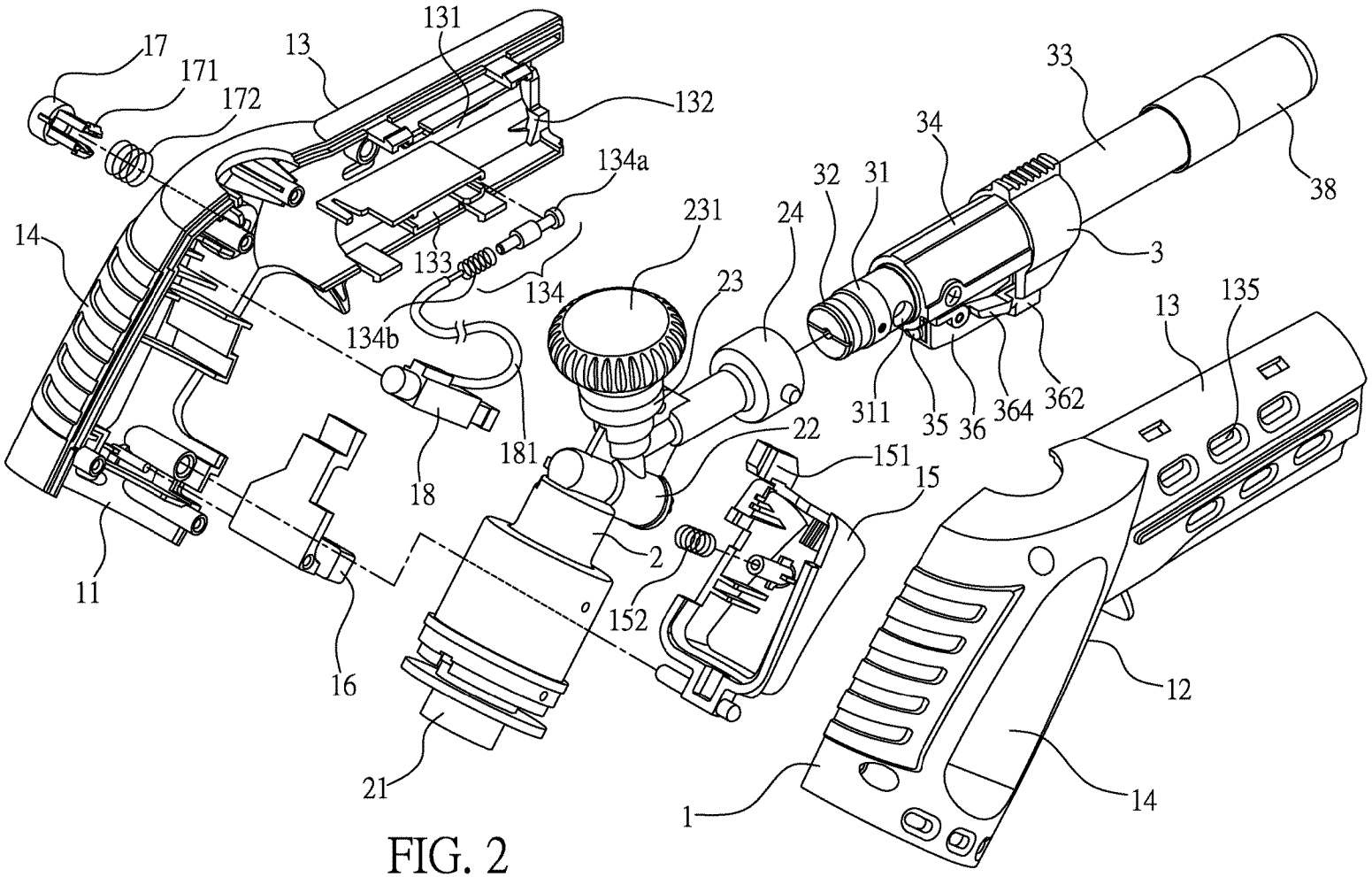
FIG. 2 is a perspective exploded view illustrating the gas combustor according to the present invention.
Figure 3:
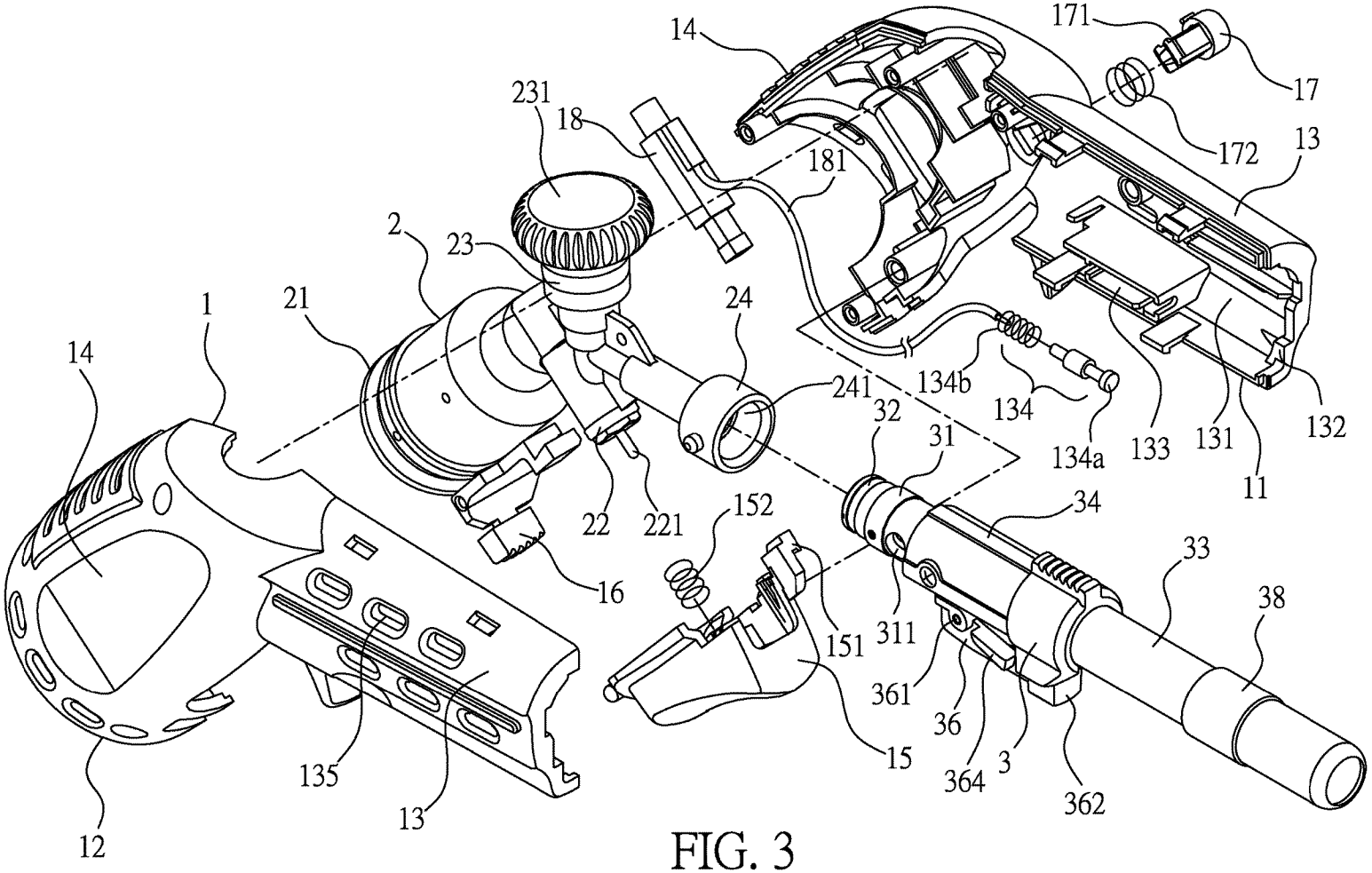
FIG. 3 is another perspective exploded view illustrating the gas combustor according to the present invention.

The technical feature of the connection pipe 13 is that the insertion slot 131 is formed in a lock-hole like status and an opened end thereof is formed with a pair of stopping protrusions 132, and the interior of the insertion slot 131 is formed with an accommodation groove 133, an elastic connecting piece 134 capable of being elastically retracted is accommodated in the accommodation groove 133, the elastic connecting piece 134 includes a mobile metal rod **134*a* sleeved with a second spring 134*b*, so the mobile metal rod 134*a* is able to be elastically refracted at the outer side of the accommodation groove 133. As shown in FIG. 2 and FIG. 3, the interior of the housing 1 is further provided with a piezoelectric device 18, and the free end of a first wire 181 of the piezoelectric device 18 is extended into the accommodation groove 133 and connected to the second spring 134*b* of the elastic connecting piece 134** thereby forming an electrical connection.

The base 2 is an integrally-formed seat member, and the interior thereof is formed with a fuel channel (deemed as prior art therefore not shown in figures), the upstream end of the fuel channel is formed with a connection part 21, e.g. a connection disc, connected to a fuel source, e.g. a canned gas, what shall be addressed is that the scope of the present invention is not limited to the above-mentioned arrangement, in actual practice, the connection part 21 can also be a fuel storage tank, so the fuel, e.g. gas, is able to enter the fuel channel through the connection part 21. The interior of the fuel channel is respectively installed with the first control valve 22 and the second control valve 23, when the valve rod 221 of the first control valve 22 is pressed by the trigger button 15, the fuel is enabled to pass the first control valve 22 and enter the second control valve 23, wherein in actual practice the second control valve 23 is preferably to be the pressure stabilizing device disclosed in the Taiwan Patent NO. I414728 (corresponding to the U.S. Pat. No. 8,449,290), thereby enabling the fuel passing the second control valve 23 to be fully vaporized then enter a sleeve pipe 24 at the downstream end of the fuel channel, a sleeve opening 241 axially preformed in the sleeve pipe 24 is installed with a third control valve 25 (as shown in FIG. 4), the third control valve 25 is a valve member which is closed in the normal status, in other words the third control valve 25 is in a closed status if not being touched or pressed, so the fully-vaporized fuel is prevented from leaking.

Figure 4:
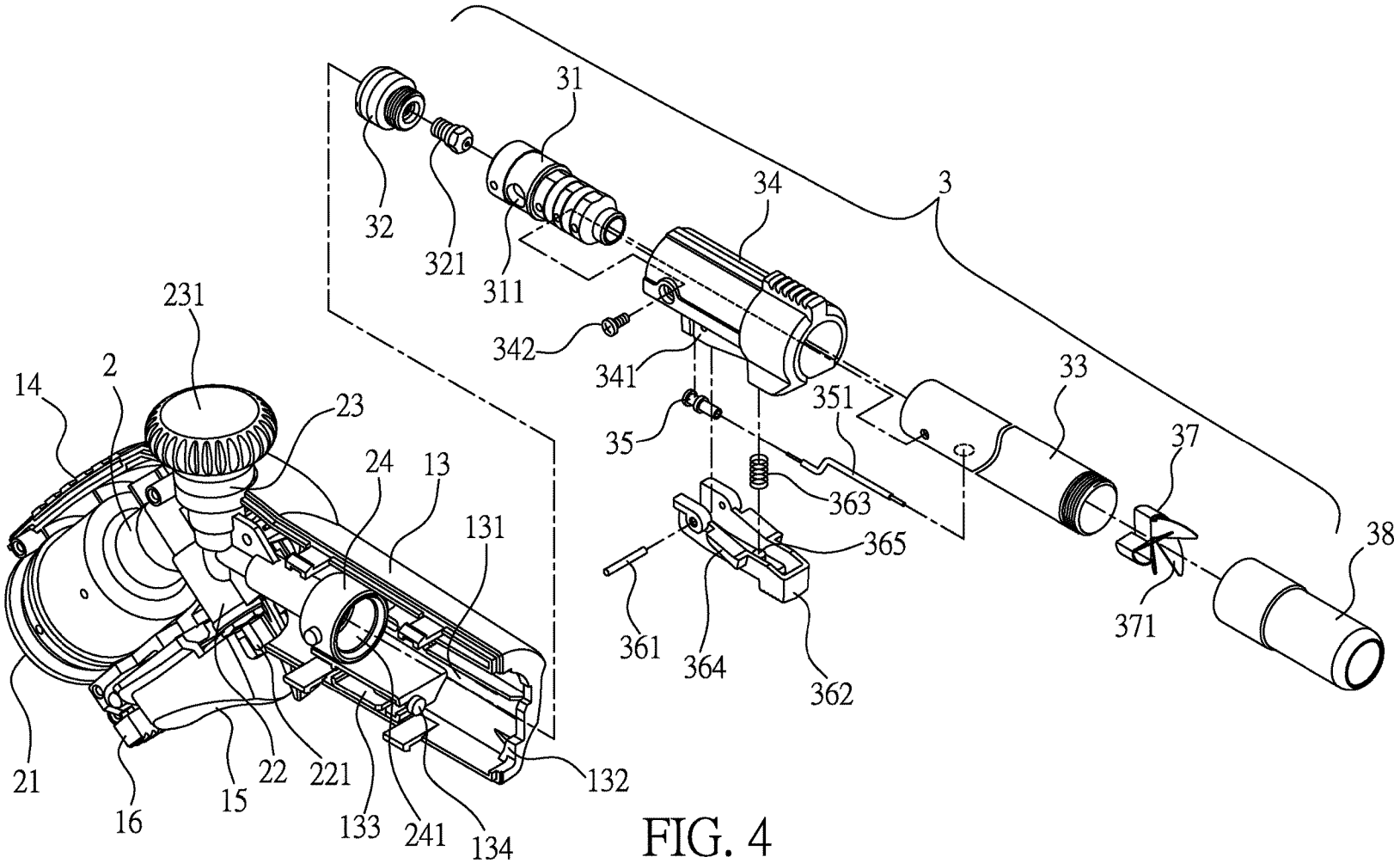
FIG. 4 is a perspective exploded view illustrating the combustion device of the gas combustor wherein the right shell of the housing being removed according to the present invention.
Figure 5:
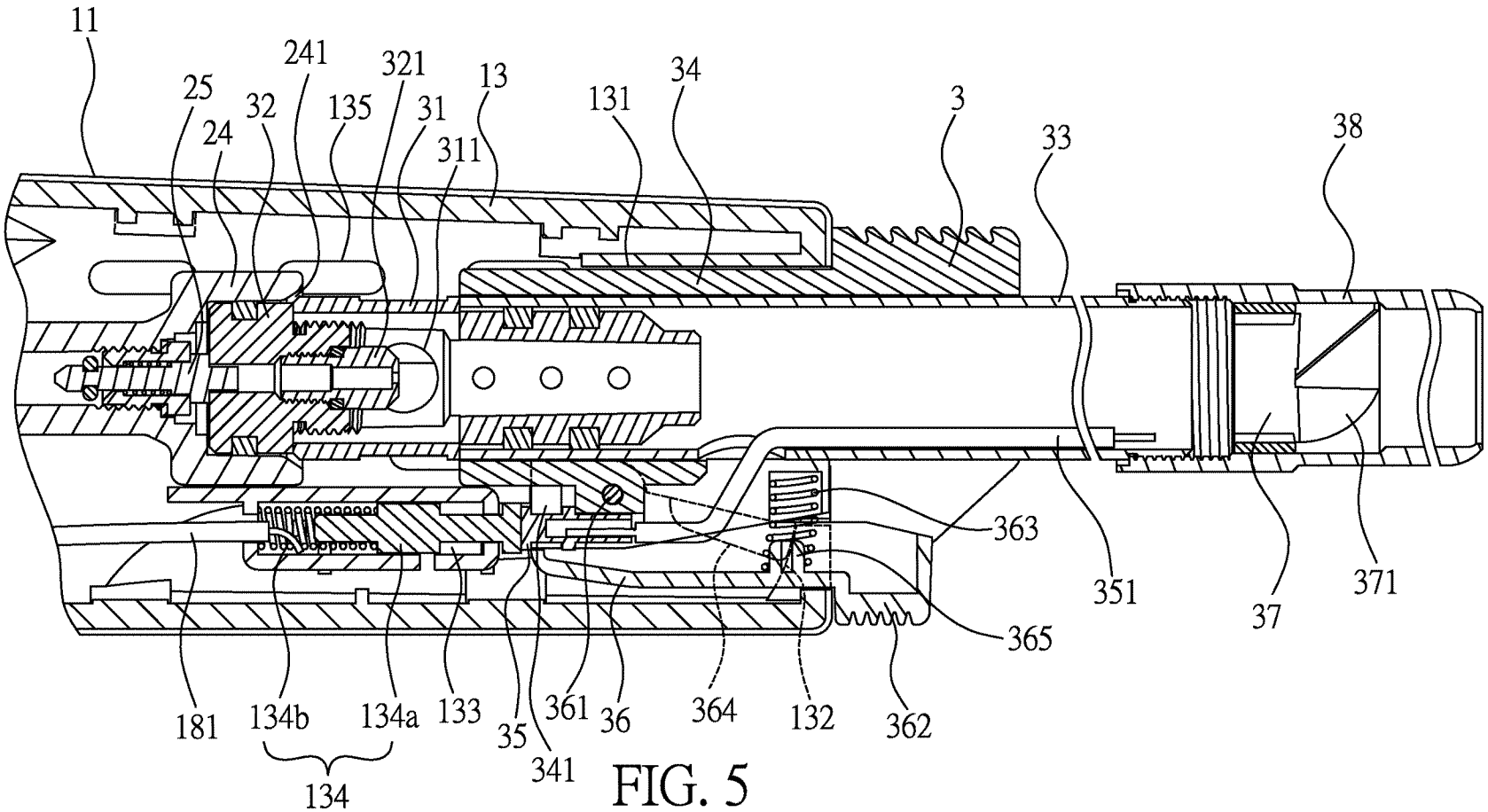
FIG. 5 is a cross sectional view illustrating the gas combustor and the combustion device being locked and connected.

As shown in FIG. 4 and FIG. 5, the combustion device 3 includes a mix pipe 31 having the upstream and the downstream ends being respectively installed with a nozzle seat 32 and an external pipe 33, the mix pipe 31 is further sleeved with a positioning seat 34, the bottom end of the positioning seat 34 is provided with a pair of positioning clamp sheets 341 capable of clamping and positioning a fixed connecting piece 35, and the fixed connecting piece 35 is connected to a second wire 351 penetrating into the external pipe 33. For allowing the positioning seat 34 to be rapidly combined with and detached from the insertion slot 131 of the connection pipe 13, one end of a lock button 36 is pivoted at the upstream end of the pair of positioning clamp sheets 341 by utilizing an insertion pin 361, and the other end of the lock button 36 is radially provided with a press button 362, a first spring 363 is disposed between the press button 362 and the bottom end of the positioning seat 34 (for example the pair of positioning clamp sheets 341), so the press button 362 is enabled to be in an outwardly expanding status through the stretching effect provided by the first spring 363. Wherein, two sides of the lock button 36 are oppositely formed with a pair of locking sheets 364 what are inclined towards the downstream, so the pair of locking sheets 364 and the pair of stopping protrusions 132 can be mutually interfered for forming a locking and combining status or staggered for forming an unlocking and detaching status.

In addition, for allowing the first spring 363 to be positioned, a recess at the top end of the lock button 36 is protrudingly formed with a spring tenon 365 allowing the first spring 363 to be inserted.

Moreover, the nozzle seat 32 at the upstream end of the mix pipe 31 is installed with a gas ejecting nozzle 321, when the nozzle seat 32 is inserted in the sleeve opening 241 of the sleeve pipe 24, the third control valve 25 is compressed for being opening, thereby enabling the fully-vaporized fuel gas with constant pressure to be ejected out from the gas ejecting nozzle 321. The mix pipe 31 is radially formed with at least a ventilation hole 311 at the position where the gas jetting nozzle 321 is disposed (i.e. the upstream end), so air can be introduced from air guiding slots 135 preformed at the periphery of the connection pipe 13, and the introduced air is able to enter the mix pipe 31 through the ventilation holes 311 for being mixed with the fuel gas ejected by the gas ejecting nozzle 321 thereby forming a mixed fuel gas, and the mixed fuel gas is able to enter the external pipe 33.

In fact, the assembly of the mix pipe 31, the external pipe 33 and the positioning seat 34 is very simple, as shown in FIG. 4, the external pipe 33 is sleeved with the mix pipe 31, then a connection member 342, e.g. a screw, is allowed to pass the positioning seat 34 and the external pipe 33 and locked on the mix pipe 31, thereby enabling the three components to be combined as one piece. The gas ejecting nozzle 321 is screw-fitted on the nozzle seat 32, and the nozzle seat 32 is screw-fitted at the upstream end of the mix pipe 31.

At this moment, a gas guiding set 37 is installed inside a flame pipe 38, and the flame pipe 38 is connected, e.g. screw-fitted, at the downstream end of the external pipe 33, so the assembly of the combustion device is finished. The front end of the gas guiding set 37 is formed with, e.g. but not limited to, inclined guiding sheets 371 having the same rotating direction, so when the mixed fuel gas passes the inclined guiding sheets 371, a vortex-like flame can be generated for forming a special combustion effect.

After the gas combustor is assembled, the base 2 is fastened inside the housing 1, and the sleeve pipe 24 having the sleeve opening 241 is disposed in the insertion slot 131 of the connection pipe 13; and the combustion device 3 is assembled as an individual elongated member. Because the combustion device 3 is not yet combined with the housing 1 and the base 2, the package volume can be effectively reduced and an advantage of easy to be carried around is provided.

When the combustion device 3 is desired to be combined with the housing 1 and the base 2, the positioning seat 34 is aimed at and inserted in the opening of the insertion slot 131 of the connection pipe 13, so the nozzle seat 32 of the mix pipe 31 is able to be moved towards the sleeve opening 241, during the inserting process, the pair of inclined locking sheets 364 are moved along the pair of stopping protrusions 132 at the opening of the insertion slot 131, so the lock button 36 allows the press button 362 to be moved towards the positioning seat 34 with the insertion pin 361 being served as a pivot, and the first spring 363 is compressed for storing energy; when the pair of locking sheets 364 cross the pair of stopping protrusions 132 and the supporting effect is no longer provided, the first spring 363 is stretched for releasing energy, and the pair of locking sheets 364 are enabled to be abutted against inner edges of the pair of stopping protrusions 132, so the interference is generated for forming the locking and combining status. At this moment, the nozzle seat 32 of the mix pipe 31 is inserted in the sleeve opening 241 of the sleeve pipe 24 thereby forming an airtight status, and the third control valve 25 is compressed for being opened; and the fixed connecting piece 35 of the positioning seat 34 is in electrical connection with the elastic connecting piece 134 in the insertion slot 131, so the assembly of the gas combustor is finished.

When the gas combustor is desired to be operated, firstly the safety button 16 is pulled for being moved from the first position to the second position so as to releasing the locking status applied to the trigger button 15, then the trigger button 15 is pressed for synchronously pushing the first control valve 21 and the piezoelectric device 18, so the fuel inside the canned gas connected to the connection part 21 of the base 2 is able to pass the first control valve 21, and the second control valve 22 is served to allow the fuel to be fully vaporized and the pressure thereof to be stabilized, then the fully-vaporized fuel gas with constant pressure enters the gas ejecting nozzle 321 through the third control valve 25 and is ejected out from the gas ejecting nozzle 321 so as to enter the mix pipe 31, the air is introduced through the plural air guiding slots 135 of the connection pipe 13 then enters the mix pipe 31 through the ventilation holes 311 so as to be mixed with the fuel gas ejected by the gas ejecting nozzle 321 for forming as the mixed fuel gas, and the mixed fuel gas is able to pass the external pipe 33 and the gas guiding set 37 for allowing the mixed fuel gas to be ejected out through the flame pipe 38.

After the piezoelectric device 18 is pushed by the trigger button 15, the generated static electricity is allowed to pass the first wire 181, the elastic connecting piece 134, the fixed connecting piece 35 and the second wire 351, thereby forming a static spark between the second wire 351 and the gas guiding set 37 for igniting the mixed fuel gas passing the gas guiding set 37, and the flame is ejected by the flame pipe 38 for processing the combustion operation.

If the combustion operation is desired to be continued, the continuous button 17 is pressed for enabling the hook part 171 to be buckled with the buckle part 151 of the trigger button 15, so the trigger button 15 is able to be continuously pressed for allowing the fuel to continuously pass the base 2 from the canned gas, and the combustion device 3 is enabled to be used for performing the combustion operation.

When the combustion operation is desired to be stopped, the trigger button 15 is pressed once again for being released from the continuous button 17, the continuous button 17 is able to be automatically recovered through the elastic member 172, and the trigger button 15 is able to be automatically recovered through the elastic unit 152 and the piezoelectric device 18, thereby allowing the first control valve 22 to be recovered to the normally-closing status for terminating the fuel supply, and the flame ejected by the flame pipe 38 is put out. Then, the safety button 16 is pulled from the second position to the first position, so the safety button 16 is able to interfere with the trigger button 15 for forming the locking status, thereby preventing children from playing with the gas combustor so as to increase the safety in use.

Figure 6:
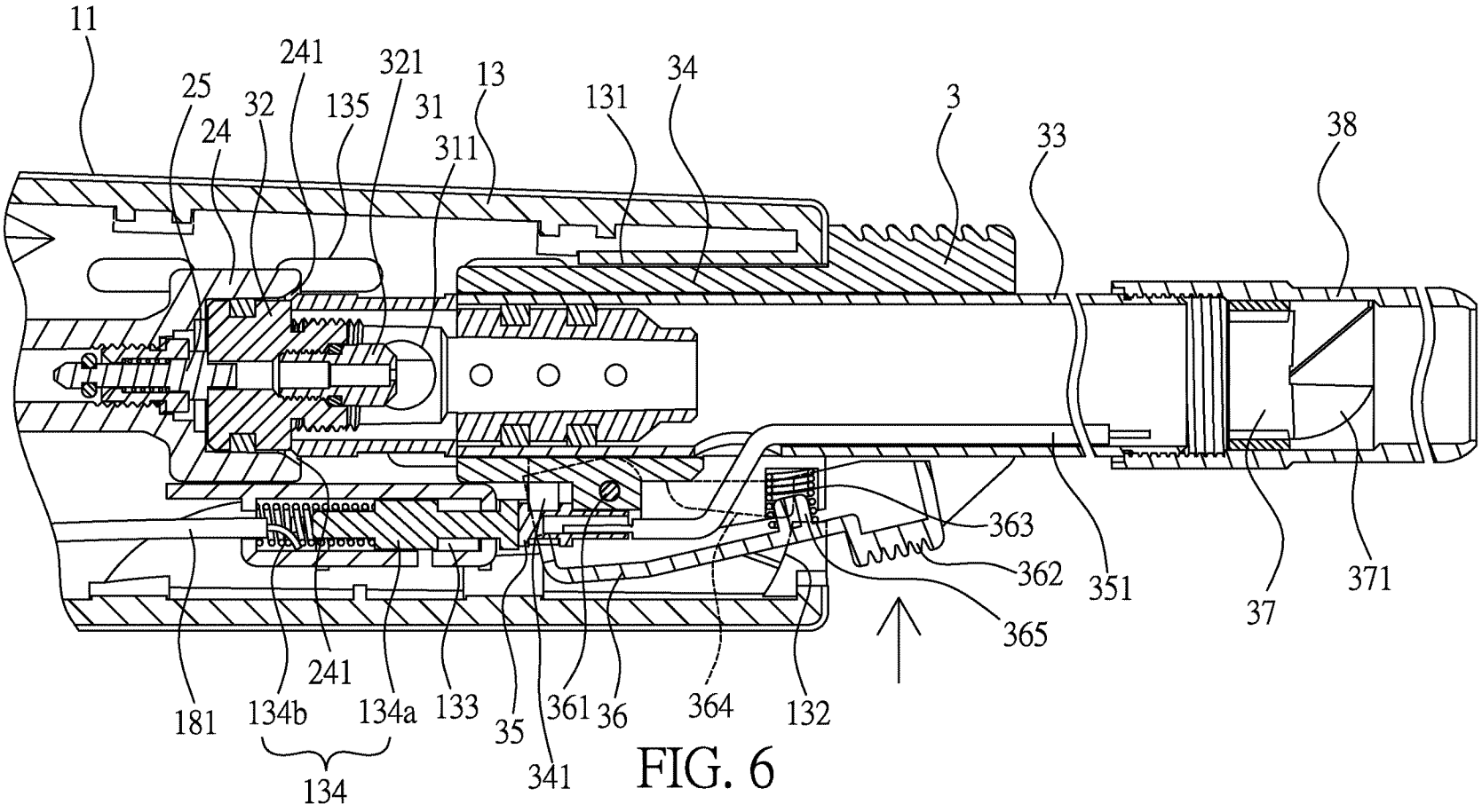
FIG. 6 is a cross sectional view illustrating the gas combustor and the combustion device being unlocked and released.

As shown in FIG. 6, when the combustion device 3 is desired to be detached from the housing 1 and the base 2, a user has to press the press button 361 of the lock button 36 for allowing the press button 361 to be moved towards the positioning seat 34 and allowing the first spring 363 to be compressed, so the pair of locking sheets 364 are upwardly moved until the press button 361 is in contact with the external pipe 33 for enabling the pair of locking sheets 364 to be on top of the pair of stopping protrusions 132, so the combustion device 3 is able to be held and outwardly pulled, thus the nozzle seat 32 and the sleeve opening 241, the fixed connecting piece 35 and the elastic connecting piece 134 are respectively formed in a releasing status, then the combustion device 3 is released from the insertion slot 131 of the connection pipe 13, so the detachment of the gas combustor is finished.

Based on what has been disclosed above, advantages achieved by the present invention are as followings: the combustion device is designed to be modularized, so different types of gas guiding set can be adopted according to the actual combustion needs for satisfying different combustion requirements; moreover, when the combustion device is inserted in the connection pipe of the housing, the fuel connection and the electric connection can be respectively established; furthermore, the combustion device is able to be combined with or detached from the gas combustor, so advantages of effectively reducing the package volume and easy to be carried around are provided. Accordingly, the gas combustor having detachable combustion device provided by the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A gas combustor having detachable combustion device, including:

a housing, the interior thereof being installed with a base formed with a fuel channel, wherein said housing being installed with a connection pipe at the downstream end of said fuel channel, an opening of an insertion slot axially formed in said connection pipe being installed with a pair of stopping protrusions, and the downstream end of said fuel channel being installed with a sleeve pipe having a sleeve opening; and a combustion device, including a mix pipe sleeved in a positioning seat, wherein the downstream end of said mix pipe being connected to an external pipe and the upstream end thereof being formed with at least a ventilation hole, one end of a lock button being pivoted at the bottom end of said positioning seat, and the other end of said lock button being radially provided with a press button, a first spring being disposed between said press button and the bottom end of said positioning seat, and two sides of said lock button being oppositely formed with a pair of locking sheets;

when said combustion device being inserted in said insertion slot, the upstream end of said mix pipe being airtightly inserted in said sleeve opening, and said pair of locking sheets being moved along said pair of stopping protrusions and crossing said pair of stopping protrusions, so said lock button allowing said first spring to respectively be compressed for storing energy or stretched for releasing energy, and said pair of locking sheets being enabled to be abutted against inner edges of said pair of stopping protrusions, so an interference being generated for forming a locking and combining status; when said press button being pressed, said lock button allowing said first spring to be compressed for storing energy, and said pair of locking sheets being upwardly moved for being on top of said pair of stopping protrusions, so said combustion device being able to be outwardly removed, thereby forming an unlocking and detaching status.

2. The gas combustor having detachable combustion device as claimed in claim 1, wherein said housing is formed with a handgrip part, the front end defined at the connecting position of said handgrip part and said connection pipe is pivoted with a trigger button capable of being pressed, and the bottom end of said trigger button is protrudingly installed with a safety button capable of being transversally pushed and moved; when said safety button is at a first position, said safety button is able to interfere with said trigger button, so said trigger button is unable to be pressed, thereby forming a locking status; when said safety button is at a second position, the interference applied to said trigger button is released, thereby forming an unlocking status.

3. The gas combustor having detachable combustion device as claimed in claim 2, wherein said handgrip part is further provided with a continuous button at one lateral side of said trigger button of said housing, when said trigger button is pressed for being in a fuel gas supplying status, said continuous button is moved from a first position to a second position, so a hook part of said continuous button is buckled with a buckle part of said trigger button, thereby enabling said trigger button to be pressed for forming a continuous fuel gas supplying status.

4. The gas combustor having detachable combustion device as claimed in claim 3, wherein an elastic member is sleeved between said continuous button and said housing, when said continuous button is no longer interfered with said trigger button, said continuous button is able to be recovered from said second position to said first position.

5. The gas combustor having detachable combustion device as claimed in claim 2, wherein an elastic unit is disposed between said trigger button and said housing.

6. The gas combustor having detachable combustion device as claimed in claim 1, wherein the interior of said insertion slot is formed with an accommodation groove, and an elastic connecting piece capable of being elastically retracted is installed in said accommodation groove; said housing further includes a piezoelectric device, the free end of a first wire of said piezoelectric device is extended into said accommodation groove and connected to said elastic connecting piece; and the bottom end of said positioning seat is provided with a pair of positioning clamp sheets capable of clamping and positioning a fixed connecting piece, and said fixed connecting piece is connected to a second wire penetrating into said external pipe; when said combustion device is inserted in said insertion slot, said fixed connecting piece is electrically connected to said elastic connecting piece.

7. The gas combustor having detachable combustion device as claimed in claim 6, wherein said elastic connecting piece includes a mobile metal rod sleeved with a second spring, so said mobile metal rod is able to be elastically retracted at the outer side of said accommodation groove, and said first wire is connected to said second spring.

8. The gas combustor having detachable combustion device as claimed in claim 1, wherein the upstream end of said fuel channel of said base is formed with a connection part connected to a fuel source, and the interior of said fuel channel is respectively installed with a first control valve and a second control valve, said first control valve is served to control fuel supply, and said second control valve is a pressure stabilizing device for enabling the fuel passing said second control valve to be fully vaporized so as enter said sleeve pipe.

9. The gas combustor having detachable combustion device as claimed in claim 1, wherein a recess at the top end of said lock button is protrudingly formed with a spring tenon allowing said first spring to be inserted.

10. The gas combustor having detachable combustion device as claimed in claim 1, wherein the upstream end of said mix pipe is installed with a nozzle seat, said nozzle seat is connected to a gas ejecting nozzle, and said sleeve opening is installed with a third control valve; when said nozzle seat is inserted in said sleeve opening, said third control valve is compressed for being opening, thereby enabling the fully-vaporized fuel gas with constant pressure to be ejected out from said gas ejecting nozzle, so said fuel gas is able to enter said mix pipe for being mixed with air introduced through said ventilation hole for forming as a mixed fuel gas so as to enter said external pipe.

11. The gas combustor having detachable combustion device as claimed in claim 1, wherein the downstream end of said external pipe is connected to a flame pipe, and the interior of said flame pipe is installed with a gas guiding set.

12. The gas combustor having detachable combustion device as claimed in claim 11, wherein the front end of said gas guiding set is formed with inclined guiding sheets having the same rotating direction.

* * * * *